US010702751B2

(12) United States Patent
Ines et al.

(10) Patent No.: US 10,702,751 B2
(45) **Date of Patent: *Jul. 7, 2020**

(54) WEIGHTED IRON SET

(71) Applicant: Acushnet Company, Fairhaven, MA (US)

(72) Inventors: Marni Ines, San Marcos, CA (US); Jonathan Hebreo, San Diego, CA (US); Michael E. Franz, San Diego, CA (US); Joshua C. Stokes, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/996,563

(22) Filed: Jun. 4, 2018

(65) Prior Publication Data

US 2018/0272200 A1 Sep. 27, 2018

Related U.S. Application Data

(63) Continuation of application No. 15/346,061, filed on Nov. 8, 2016, now Pat. No. 10,022,600, which is a continuation of application No. 14/626,531, filed on Feb. 19, 2015, now abandoned.

(51) Int. Cl.

| | |
|---|---|
| ***A63B 53/04*** | (2015.01) |
| ***A63B 60/02*** | (2015.01) |
| *A63B 53/00* | (2015.01) |

(52) U.S. Cl.

CPC ..... *A63B 53/047* (2013.01); *A63B 60/02* (2015.10); *A63B 2053/005* (2013.01); *A63B 2053/042* (2013.01); *A63B 2053/0408* (2013.01); *A63B 2053/0491* (2013.01)

(58) Field of Classification Search

CPC ..... A63B 53/047; A63B 2053/0408; A63B 2053/0491; A63B 2053/005; A63B 60/02; A63B 2053/042; A63B 53/12; A63B 2102/32; A63B 53/04

See application file for complete search history.

(56) References Cited

U.S. PATENT DOCUMENTS

| | | | |
|---|---|---|---|
| 3,995,865 | A | 12/1976 | Cochran |
| 4,645,207 | A | 2/1987 | Teramoto et al. |
| 4,754,971 | A | 7/1988 | Kobayashi |
| 4,874,171 | A | 10/1989 | Ezaki et al. |

(Continued)

FOREIGN PATENT DOCUMENTS

| | | | |
|---|---|---|---|
| JP | 06-335538 | H | 12/1994 |
| JP | 08024373 | H | 1/1996 |

(Continued)

OTHER PUBLICATIONS

Office Action dated Oct. 14, 2016 of co-pending U.S. Appl. No. 14/626,531.

(Continued)

*Primary Examiner* — Stephen L Blau

(57) ABSTRACT

The present invention is direct to a set of golf clubs comprising long irons, mid-irons and short irons. The invention contemplates the use of titanium or steel for the main body portion and significant tungsten weight members at the heel and toe.

10 Claims, 4 Drawing Sheets

(56) References Cited

U.S. PATENT DOCUMENTS 5,184,823 A * 2/1993 Desboilles ..... A63B 53/04 473/345
5,295,686 A 3/1994 Lundberg
5,316,297 A 5/1994 Chappell
5,333,872 A 8/1994 Manning
5,524,880 A * 6/1996 Kobayashi ..... A63B 53/00 473/291
5,564,705 A 10/1996 Kobayasi et al.
5,643,107 A * 7/1997 Gorman ..... A63B 53/04 473/328
5,669,825 A 9/1997 Shira
5,669,826 A 9/1997 Chang
5,722,900 A 3/1998 Sung
5,833,551 A * 11/1998 Vincent ..... A63B 53/04 473/350
5,935,020 A 8/1999 Stites et al.
5,984,803 A * 11/1999 Chappell ..... A63B 53/00 473/291
6,089,990 A 7/2000 Kimura
6,290,607 B1 9/2001 Gilbert et al.
6,482,104 B1 11/2002 Gilbert
6,602,147 B2 8/2003 Shiraishi
6,623,374 B1 9/2003 Helmstetter et al.
6,638,183 B2 * 10/2003 Takeda ..... A63B 53/047 473/335
6,746,343 B2 * 6/2004 Yoneyama ..... A63B 53/04 473/342
6,857,973 B2 * 2/2005 Wieland ..... A63B 53/047 473/342
6,860,819 B2 3/2005 Gilbert
7,014,568 B2 3/2006 Pelz
7,022,028 B2 4/2006 Nagai et al.
7,186,187 B2 3/2007 Gilbert et al.
7,244,188 B2 7/2007 Best
7,559,850 B2 7/2009 Gilbert et al.
7,699,716 B2 4/2010 Burnett et al.
7,935,000 B2 5/2011 Stites
8,012,040 B2 * 9/2011 Takechi ..... A63B 53/047 473/329
8,157,673 B2 4/2012 Gilbert
8,235,832 B2 8/2012 Burnett et al.
8,241,141 B2 * 8/2012 Takechi ..... A63B 53/047 473/329
8,246,488 B2 * 8/2012 Stevens ..... A63B 53/04 473/335
8,342,985 B2 * 1/2013 Hirano ..... A63B 53/047 473/350
8,491,407 B2 7/2013 Shear et al.
8,740,721 B2 * 6/2014 Yamamoto ..... A63B 53/047 473/312
8,821,313 B1 9/2014 Dawson
8,900,070 B1 * 12/2014 Dawson ..... A63B 53/047 473/329
8,911,304 B1 * 12/2014 Dawson ..... A63B 53/0475 473/350
9,011,270 B2 * 4/2015 Nakano ..... A63B 53/047 473/350
9,427,635 B2 8/2016 Ines
2004/0214655 A1 * 10/2004 Reed ..... A63B 53/047 473/290
2009/0247313 A1 * 10/2009 Nakano ..... A63B 53/0466 473/290
2011/0070969 A1 * 3/2011 Stevens ..... A63B 53/04 473/334
2012/0122606 A1 5/2012 Yamamoto
2013/0344988 A1 12/2013 Hettinger et al.
2016/0250525 A1 * 9/2016 Motokawa ..... A63B 53/0466 473/336

FOREIGN PATENT DOCUMENTS

JP H09271545 A 10/1997
JP 10-277186 H 10/1998
JP 2000084128 A 3/2000
JP 2006-025935 A 2/2006
JP 2006-231064 A 9/2006
JP 2014-000410 A 1/2014

OTHER PUBLICATIONS

Office Action dated Apr. 25, 2016 of co-pending U.S. Appl. No. 14/626,531.
U.S. Appl. No. 15/245,906, filed Aug. 24, 2016, Ines et al.
U.S. Appl. No. 15/346,061, filed Nov. 8, 2016, Ines et al.

* cited by examiner

WEIGHTED IRON SET

RELATED APPLICATIONS

The present application is a continuation of co-pending U.S. application Ser. No. 15/346,061, filed on Nov. 8, 2016, which is a continuation of co-pending U.S. application Ser. No. 14/626,531, filed on Feb. 19, 2015, which are hereby incorporated by reference in their entirety.

TECHNICAL FIELD OF THE INVENTION

The present invention generally relates to sets of iron golf clubs, and more particularly, to sets of iron golf clubs that are comprised of significant tungsten weighting.

BACKGROUND OF THE INVENTION

In conventional sets of "iron" golf clubs, each club includes a shaft with a club head attached to one end and a grip attached to the other end. The club head includes a face for striking a golf ball. The angle between the face and a vertical plane is called "loft." In general, the greater the loft is of the golf club in a set, the greater the launch angle and the less distance the golf ball is hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 iron and a 2 iron, but these clubs are generally sold separate from the set. Each iron has a shaft length that usually decreases through the set as the loft for each club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The highest point of the long iron's ball flight is generally lower than the highest point for the short iron's ball flight. The mid irons, such as the 5 iron, produce an initial trajectory that is between those exhibited by balls hit with the long and short irons.

SUMMARY OF THE INVENTION

The present invention is directed to a set of golf clubs comprising at least a first club head having a loft between about 15 and 25 degrees (long irons), a second club head having a loft of between about 26 and 35 degrees (mid irons), and a third club head having a loft of about 36 degrees or greater (short irons). Within the set, the first, second and third club heads each have a heel, a toe, a topline, a sole, a hosel and a front face having a face center. Each of the club heads has a club head mass that is different than the other club head mass by at least 5 grams. Further, the set includes at least one club head that has a tungsten heel member and a tungsten toe member that together comprise more that 50% of the club head mass. More preferably, each of the long irons and the mid irons are comprised of tungsten weight members that are at least 50% of the club head mass.

The present invention is also directed to a set of irons where the long and mid irons each have a tungsten heel member and a tungsten toe member, wherein the tungsten heel member plus the tungsten toe member weigh 135 grams or greater. Preferably, the long and mid irons are comprised of titanium and tungsten and the tungsten portion forms more than 25% of the club heads' volume. In a preferred embodiment, the short iron is comprised of titanium and steel and the steel portion comprises between 50% and 70% of the club head mass.

The present invention is also directed to a set of golf clubs comprising at least a first club head having a loft between about 15 and 25 degrees, a second club head having a loft of between about 26 and 35 degrees, and a third club head having a loft of about 36 degrees or greater, where each club head has a club head mass that is different than the one preceding it by at least 5 grams and at least one club head is comprised of a steel body member and a steel face insert that together comprise less than 75 percent of the overall club head mass. Preferably, the club head includes a tungsten heel member and a tungsten toe member that together comprise more that 25% of the club head mass. More preferably, the tungsten heel member plus the tungsten toe member weigh 70 grams or greater.

In a preferred embodiment of the invention, the long irons and mid irons are comprised of steel and tungsten and the tungsten portion forms at least about 20 percent of the club heads' solid volume. Still further, at least one short iron can be comprised of steel and tungsten and the tungsten portion comprises at least about 20 percent of the club head mass.

The present invention also contemplates a set of golf clubs comprising at least a long iron having a first blade length, a first hosel length and a first scoreline width, a mid iron having a second blade length, a second hosel length and a second scoreline width, and a short iron having a third blade length, a third hosel length and a third scoreline width, where the blade lengths are approximately constant and the second hosel length is greater than the first hosel length and the third hosel length is greater than the second hosel length. Also the second scoreline width is preferably less than the first scoreline width and the third scoreline width is preferably less than the second scoreline width. In a preferred embodiment, long iron has a first toe height, the mid iron has a second toe height greater than the first toe height and the short iron has a third toe height greater than the second toe height. Still further, the long iron can have a first sole width, the mid iron can have a second sole width less than the first sole width and the short iron can have a third sole width less than the second sole width.

In the preferred embodiment of the current invention, the long iron has a first tungsten toe member, the mid iron has a second tungsten toe member with greater mass than the first tungsten toe member and at least one short iron has a third tungsten toe member with greater mass than the second tungsten toe member. Conversely, in the preferred embodiment, the long iron has a first tungsten heel member and the mid iron has a second tungsten heel member with less mass than the first tungsten heel member.

DETAILED DESCRIPTION OF THE PREFERRED EMBODIMENTS

As illustrated in the accompanying drawings and discussed in detail below, the present invention is directed to an improved set of iron-type golf clubs, wherein the clubs have tungsten weight members that form a significant portion of the club heads' mass.

Figure 1:
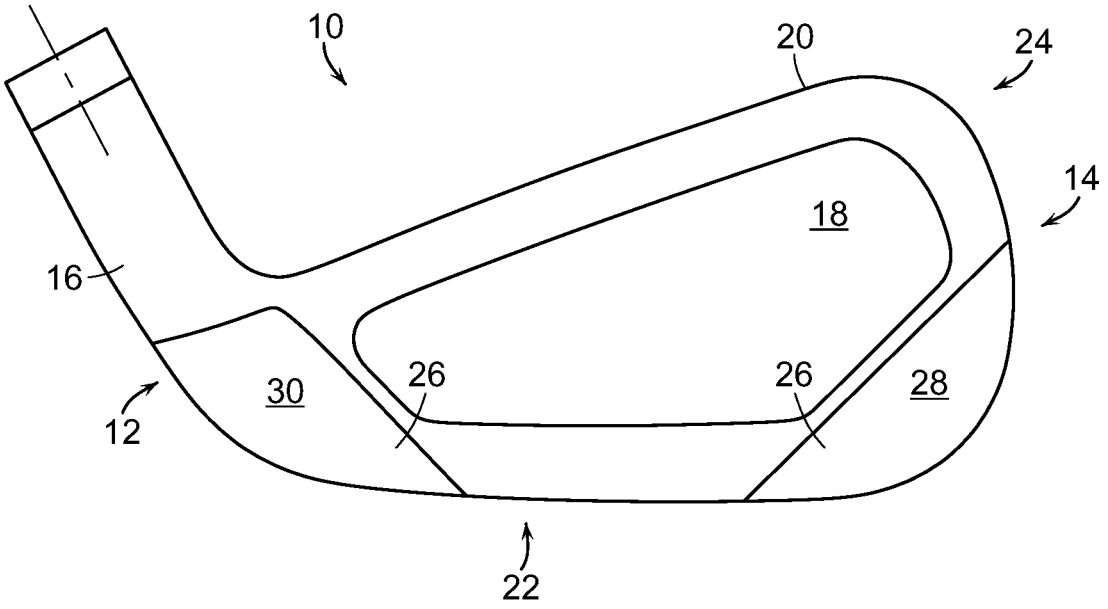
FIG. 1 is a back view of an iron according to the present invention.
Figure 2:
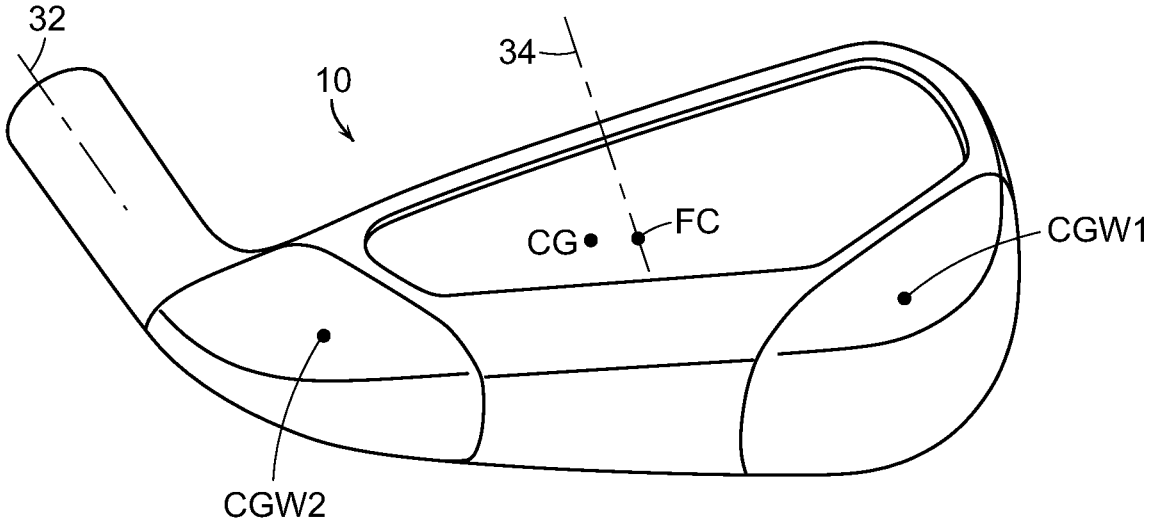
FIG. 2 is a perspective view of the iron in FIG. 1.

Referring to FIGS. 1 and 2, an iron 10 has a heel 12, a toe 14, a hosel 16, a back cavity 18 a top line 20 and a sole 22. The iron is comprised of two main components, the main body 24 and the weight members 26. The iron includes a hosel axis 34 and a face center FC. The main body 24 is formed from titanium, or more preferably, a titanium alloy. For at least the long irons and mid irons, the weight members include a toe weight member 28 and a heel weight member 30 that are formed from tungsten or more preferably a tungsten alloy having a specific gravity of 15 g/cm3 or greater. Thus, the main body 24 will have a specific gravity of about 4-5 g/cm3 and the weight members 26 will have a specific gravity of about 15-20 g/cm3.

Table I provides exemplary, non-limiting dimensions for the various measurements of clubs according to the Example of the invention. It is fully intended that all of the dimensions set forth below can be adjusted such that the overall objective of the individual irons is met.

TABLE I

| Club Number | 3 | 4 | 5 | 6 | 7 | 8 | 9 | P |
|---|---|---|---|---|---|---|---|---|
| loft | 21 | 24 | 27 | 30 | 34 | 38 | 42 | 46 |
| Mass | 238 | 245 | 252 | 259 | 266 | 274 | 282 | 286 |
| Ti (g) | 103 | 100 | 102 | 109 | 116 | 94 | 102 | 106 |
| W (g) | 135 | 145 | 150 | 150 | 150 | | | |
| Steel (g) | | | | | | 180 | 180 | 180 |
| Ti % | 43.3 | 40.8 | 40.5 | 42.1 | 43.6 | 34.3 | 36.2 | 37.1 |
| W % | 56.7 | 59.2 | 59.5 | 57.9 | 56.4 | | | |

TABLE I-continued

| Club Number | 3 | 4 | 5 | 6 | 7 | 8 | 9 | P |
|---|---|---|---|---|---|---|---|---|
| Steel % | | | | | | 65.7 | 63.8 | 62.9 |
| Ti vol. ($cm^3$) | 22.9 | 22.2 | 22.7 | 24.2 | 25.8 | 20.9 | 22.7 | 23.6 |
| W vol. ($cm^3$) | 9.0 | 9.7 | 10 | 10 | 10 | | | |
| Steel Vol. ($cm^3$) | | | | | | 24 | 24 | 24 |

Referring to the data in Table I above, the set of irons according to the present invention can be separated into long irons that have a loft of between about 15 and 25 degrees, mid irons that have a loft of between about 26 and 35 degrees and short irons that have a loft of about 36 or greater. The total mass of the clubs increases throughout the set from about 235 grams to about 290 grams. Each club is preferably about 5 grams or more greater in mass than the previous iron. As shown, for example, the 4 iron is 7 grams greater than the 3 iron. Thus, the mass increases through the set.

Each of the irons includes a titanium body member. The long irons and the mid irons preferably have tungsten weight members 28 and 30 as shown in FIGS. 1 and 2. In the long irons, the titanium body member 24 has a mass that is less than about 120 grams and more particularly, about 100 grams. The toe weight member 28 and heel weight member 30 preferably have a mass of about 130 grams to 150 grams. Thus, the tungsten weight members are greater than 50% of the total club mass.

In the mid irons, the titanium body member 24 has a mass that is less than about 120 grams and more particularly, about 100 grams to about 115 grams. The tungsten toe weight member 28 and heel weight member 30 preferably have a mass of about 140 grams to 160 grams, and more particularly about 150 grams. Thus, the tungsten weight members are greater than 50% of the total club mass. Also, the tungsten weight members 28 and 30 have greater mass than the tungsten weight members 28 and 30 for the long irons.

In the short irons, the titanium body member 24 has a mass that is less than about 120 grams and more particularly, about 90 grams to about 110 grams. The toe weight member 28 and heel weight member 30 are preferably made of steel and preferably have a mass of about 160 grams to 200 grams, and more particularly about 180 grams. Thus, the steel weight members are greater than 50% of the total club mass. Also, the steel weight members 28 and 30 have greater mass than the tungsten weight members 28 and 30 for the long irons and of the mid irons.

TABLE II

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Total Mass (g) | 234 | 239 | 246 | 252 | 256 | 267 | 274 | 282 | 286 |
| Body Mass (g) | 116 | 117 | 118 | 118 | 132 | 139 | 164 | 170 | 240 |
| Face Mass (g) | 34 | 37 | 38 | 38 | 38 | 39 | 41 | 41 | 41 |
| Toe W (g) | 38 | 45 | 50 | 55 | 61 | 60 | 61 | 63 | |
| Heel W (g) | 34 | 32 | 31 | 31 | 20 | 20 | | | |
| Steel Mass % | 70 | 68 | 67 | 66 | 68 | 70 | 78 | 78 | 100 |
| W Mass % | 30 | 32 | 33 | 34 | 32 | 30 | 22 | 22 | |
| Steel vol. % | 80 | 79 | 78 | 77 | 80 | 81 | 86 | 86 | 100 |
| W vol. % | 20 | 21 | 22 | 23 | 20 | 19 | 14 | 14 | |

TABLE III

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Blade Length (mm) | 77.6 | 77.6 | 77.6 | 77.6 | 77.6 | 77.6 | 77.6 | 77.6 | 77.6 |

TABLE III-continued

| Club Number | 2 | 3 | 4 | 5 | 6 | 7 | 8 | 9 | P |
|---|---|---|---|---|---|---|---|---|---|
| Toe Height (mm) | 51.9 | 52.3 | 52.8 | 53.3 | 53.8 | 54.3 | 54.9 | 55.4 | 55.8 |
| Scoreline Width (mm) | 53.2 | 53.0 | 52.8 | 52.7 | 52.5 | 52.3 | 52.2 | 52 | 51.8 |
| Scoreline to Toe (mm) | 17.3 | 17.5 | 17.7 | 17.8 | 18 | 18.2 | 18.3 | 18.5 | 18.7 |
| Hosel Length (mm) | 62 | 63 | 64 | 65 | 66 | 67 | 68 | 69 | 70 |
| Sole Width (mm) | 19.7 | 19.4 | 19.0 | 18.5 | 18.0 | 17.4 | 16.8 | 16.1 | 15.4 |

Figure 3:
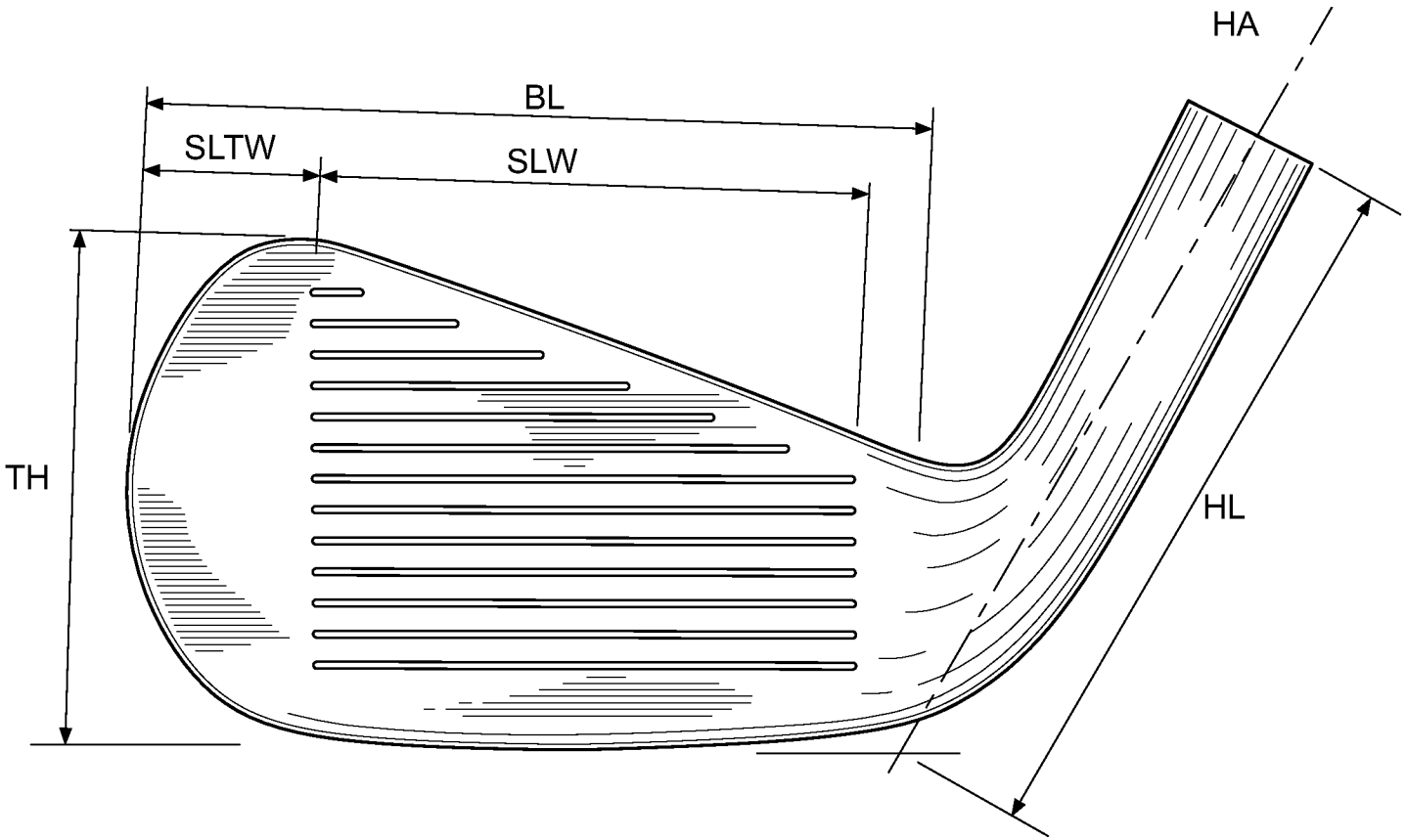
FIG. 3 is a front view of a long iron according to another embodiment of the present invention.

As shown in FIG. 3 and set forth in Table III above, another embodiment of the present invention includes a set of irons that have a substantially constant Blade Length (BL) throughout the set. The BL is defined at the length from the hosel axis (HA) intersection with the ground plane to the end of the toe. However in this set, the Toe Height (TH) progressively increases through the set. Thus, the TH of the mid iron is greater than the TH of the long iron and the TH of the short iron is greater than the TH of the mid iron and the long iron. The TH is defined as the maximum length from the leading edge to the top of the toe in the plane parallel to the face plane and perpendicular to the scorelines. Preferably, the TH increases by about at least 0.3 mm per club, and most preferably at least 0.4 mm per club. Also, the TH preferably increases at least 1 mm per club (or about 4 degrees of loft) for the short irons and only 0.3-0.6 mm per club for the long and mid irons.

Furthermore, even though the BL remains substantially constant through the set, the scoreline width (SLW) progressively decreases through the set and the scoreline to toe width (SLTW) progressively increases through the set. More particularly, the SLW decreases by at least about 0.1 mm per club (or per 4 degrees of loft). Thus, the SLW for the long iron is greater than the SLW for the mid iron and the SLW for the mid iron is greater than the SLW for the short iron. Moreover, because the SLTW progressively increases through the set, the non-grooved toe area increases throughout the set.

Still further, in this preferred embodiment of the present invention, the distance of the center of gravity from the face center progressively increases through the set. Thus, CG-Xfc progressively increases from less than 2 mm from the face center in the long irons to about 3 mm from the face center towards the hosel in the short irons.

Another aspect of the present invention is that the hosel length HL increases through the set. Preferably, the hosel length increases by about 1 mm/club (or per 4 degrees of loft) such that the HL of the mid irons is greater than the HL of the long irons and the HL of the short irons is greater than the HL of the mid irons. Also, the sole width, not shown in the figures because it is the width of the sole at the center of the club head perpendicular to the front view shown in FIG. 3, decreases through the set. Thus, the sole width of the mid irons is less than the sole width of the long irons and greater than the sole width of the short irons. Preferably, the sole width decreases by about 0.3 mm/club (or per 4 degrees of loft).

Figure 4:
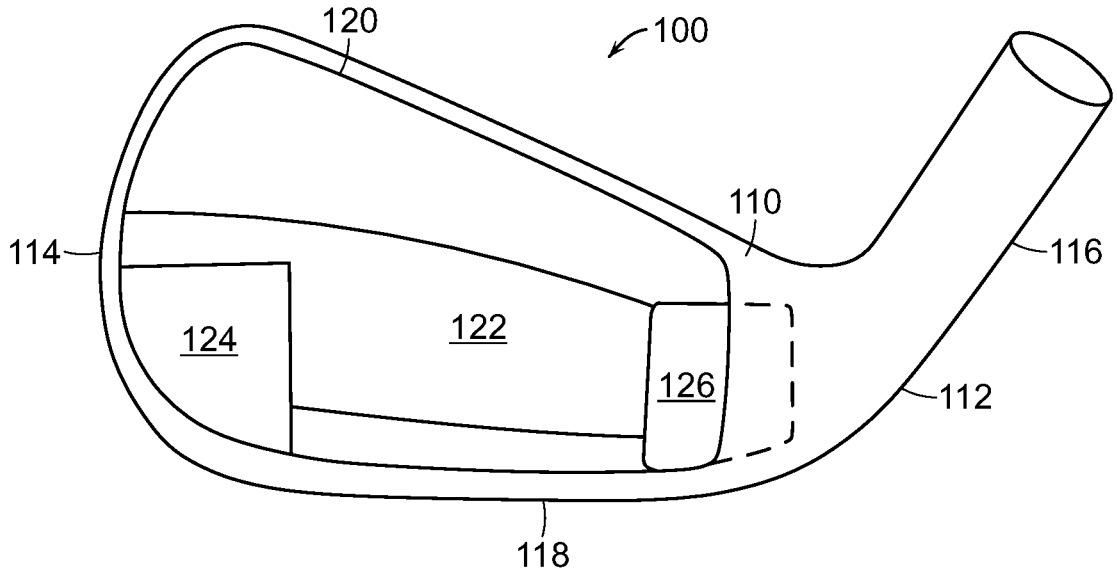
FIG. 4 is a front view of a long iron body member according to the present invention.

As shown in FIGS. 4-7 and set forth in the table above, the set includes a long iron 100, a mid iron 200, a first short iron 300 and a second short iron 400. In FIG. 4, the long iron 100 includes a body member 110, heel 112, a toe 114, a hosel 116 and a sole 118. The iron body 110 includes an insert aperture 120 and a hollow portion 122. A face insert, not shown, is welded to the insert aperture 120 to enclose the hollow portion 122. Both the body member 110 and the face insert are preferably formed of steel. Inside the hollow portion 122, a tungsten toe weight member 124 and a tungsten heel weight member 126 are located proximate the toe 114 and the heel 112, respectively, to create a high moment of inertia. As shown in Table II above, the body member 110 preferably has a mass of about 110 grams to 120 grams and the face insert has a mass of about 30 grams to 45 grams. In the long irons 100, the toe weight member 124 preferably has a mass of about 35 to 55 grams. Preferably, the toe weight member 124 mass increases with each club by about 5 grams per club. The heel weight member 126 is preferably about 30 grams to 35 grams and preferably decreases by about 1 or 2 grams per club. Preferably, the tungsten mass of the toe weight member 124 and the heel weight member 126 are at least 25% of the total club head mass and at least 15% of the total club head solid volume. More particularly, the toe weight member 124 and the heel weight member comprise about 30% of the total mass or more and 20% of the total solid volume. Preferably, the toe weight member 124 has greater mass than the heel weight member 126.

Figure 5:
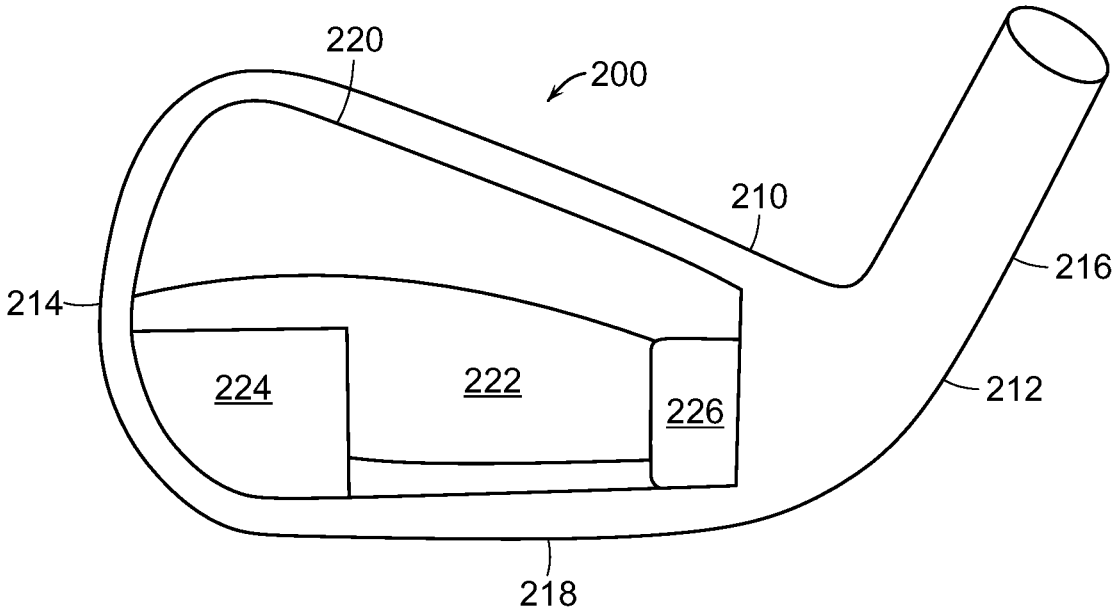
FIG. 5 is a front view of a mid-iron body member according to the present invention.

As shown in FIG. 5 and set forth in Table II above, the set includes a mid iron 200 that includes a body member 210, heel 212, a toe 214, a hosel 216 and a sole 218. The iron body 210 includes an insert aperture 220 and a hollow portion 222. A face insert, not shown, is welded to the insert aperture 220 to enclose the hollow portion 222. Both the body member 210 and the face insert are preferably formed of steel. Inside the hollow portion 222, a tungsten toe weight member 224 and a tungsten heel weight member 226 are located proximate the toe 214 and the heel 212, respectively, to create a high moment of inertia. As shown in Table II above, the body member 210 preferably has a mass of about 115 grams to 145 grams and the face insert has a mass of about 30 grams to 45 grams. In the mid irons 200, the toe weight member 224 preferably has a mass of about 50 to 70 grams. Preferably, the toe weight member 224 mass increases with each club by about 5 grams per club. The heel weight member 226 is preferably about 35 grams or less and preferably decreases per club. Preferably, the tungsten mass of the toe weight member 224 and the heel weight member 226 are at least 25% of the total club head mass and at least 15% of the total club head solid volume. More particularly, the toe weight member 224 and the heel weight member 226 comprise about 30% of the total mass or more and about 20% of the total solid volume. Preferably, the toe weight member 224 has greater mass than the heel weight member 226, and more preferably, is about twice the amount of mass.

Figure 6:
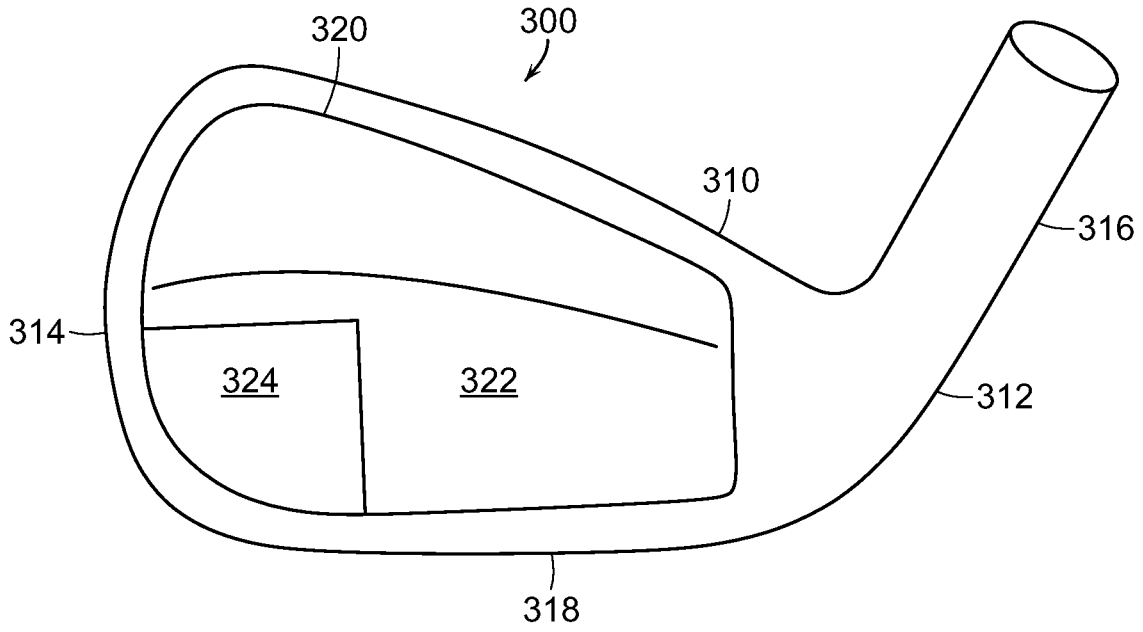
FIG. 6 is a front view of a short iron body member according to the present invention.

As shown in FIG. 6 and as set forth in Table II above, the set can include a short iron 300 that includes a body member 310, heel 312, a toe 314, a hosel 316 and a sole 318. The iron body 310 includes an insert aperture 320 and a hollow portion 322. A face insert, not shown, is welded to the insert aperture 320 to enclose the hollow portion 322. Both the body member 310 and the face insert are preferably formed of steel. Inside the hollow portion 322, a tungsten toe weight member 324 is located proximate the toe 314, to create a high moment of inertia. As shown in Table II above, the body member 310 preferably has a mass of about 150 grams to 200 grams and the face insert has a mass of about 30 grams to 45 grams. In the short iron 300, the toe weight member 324 preferably has a mass of about 55 to 70 grams. Preferably, the tungsten mass of the toe weight member 324 is at least 20% of the total club head mass and at least 10% of the total club head solid volume.

Figure 7:
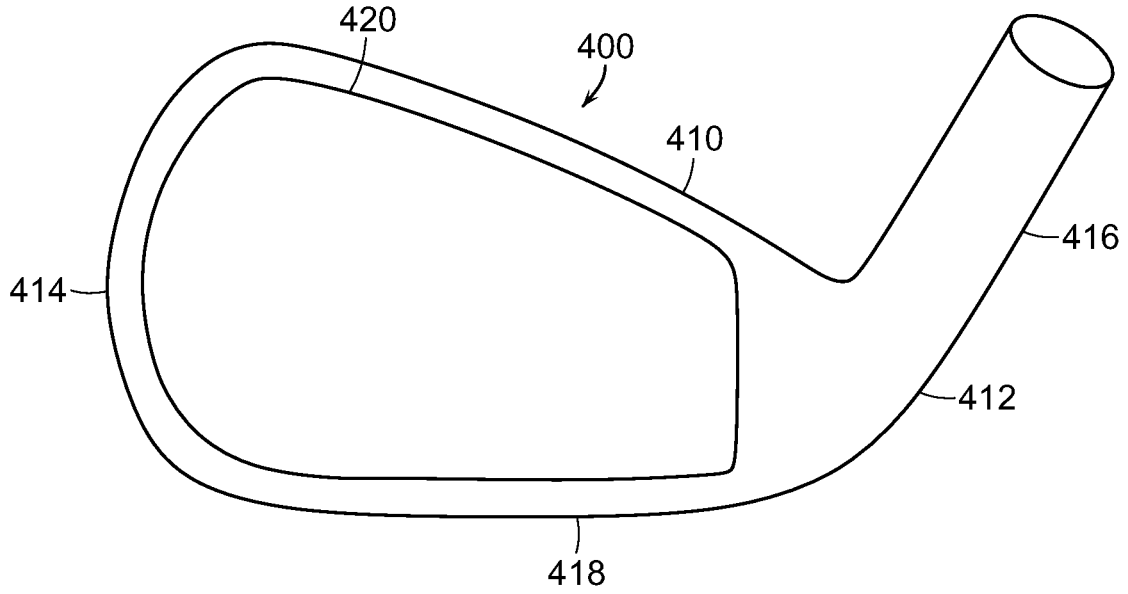
FIG. 7 is a front view of another embodiment of a short iron body member according to the present invention.

As shown in FIG. 7 and as set forth in Table II above, the set can include a short iron 400 that includes a body member 410, heel 412, a toe 414, a hosel 416 and a sole 418. The iron body 410 includes an insert aperture 420. A face insert, not shown, is welded to the insert aperture 420. The short iron 400 is preferably substantially solid and does not contain tungsten weight members.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

What is claimed is:

1. A set of golf clubs comprising at least a first club head having a loft between about 15 and 25 degrees, a second club head having a loft of between about 26 and 35 degrees, and a third club head having a loft of about 36 degrees or greater, wherein:

the first, second and third club heads each comprise a solid volume, a heel, a toe, a topline, a sole, a hosel and a front face having a face center;

wherein the first club head has an overall club head mass and is comprised of a first steel body member and a first steel face insert that together form an enclosed hollow portion and comprise less than 75 percent of the overall club head mass and is further comprised of a first tungsten heel member having a mass of about 30 g to 35 g located in a heel portion of the enclosed hollow portion and a first tungsten toe member located in a toe portion of the enclosed hollow portion, wherein the first tungsten toe member has greater mass than the first tungsten heel member and the first tungsten heel member and the first tungsten toe member together comprise more than 25 percent of the overall club head mass.

2. The set of golf clubs of claim 1, wherein the first steel body member has a mass of between 110 g to 120 g and the first steel face insert has a mass of 30 g to 45 g.

3. The set of golf clubs of claim 2, wherein the second club head has a second club head mass and comprises a second steel body member and a second steel face insert that together form a second enclosed hollow portion and comprise less than 75 percent of the second club head mass, and is further comprised of a second tungsten heel member having a second tungsten heel member mass and located in a heel portion of the second enclosed hollow portion and a second tungsten toe member located in a toe portion of the second enclosed hollow portion that has about twice an amount of mass as the second tungsten heel member mass, wherein the second tungsten heel member plus the second tungsten toe member comprise at least 25 percent of the second club head mass.

4. The set of golf clubs of claim 3, wherein the first tungsten heel member plus the first tungsten toe member form at least about 20 percent of the first club heads' solid volume and the second tungsten heel member plus the second tungsten toe member form at least about 20 percent of the second club heads' solid volume.

5. The set of golf clubs of claim 3, wherein the third club head has a third club head mass is comprised of a third steel body member and a third steel face insert that form a third enclosed hollow portion, and further comprises a third tungsten toe member that comprises at least about 20 percent of the third club head mass.

6. The set of golf clubs in claim 1, wherein there are three first club heads and each of the first club heads comprises a tungsten toe member and mass of the tungsten toe members for the first club heads increases by about 5 g per club head and each of the first club heads has a hosel length and the hosel length increases per club head.

7. The set of golf clubs in claim 6, wherein each of the first club heads includes a tungsten heel member and mass of the tungsten heel members decreases by about 1 to 2 g per club head.

8. A set of golf clubs comprising at least a first golf club, a second golf club, and a third golf club, wherein:

the first, second and third golf clubs are each comprising a heel, a toe, an upper surface, a lower surface, and a hosel, and the first golf club further comprising a first loft angle ($LA_1$) of between 15 and 25 degrees and being formed from a first steel body member having a mass of between 110 g to 120 g, a first steel face insert having a mass of 30 g to 45 g that together form a first enclosed hollow portion, a first tungsten heel member having a mass of about 30 g to 35 g located in a heel side of the first enclosed hollow portion and a first tungsten toe member having a mass of 35 g to 55 g and located in a toe side of the first enclosed hollow portion, and a first blade length;

the second golf club further comprising a second loft angle ($LA_2$) of between 26 and 35 degrees and being formed from a second steel body member having a mass of 115 g to 145 g, a second steel face insert having a mass of 30 g to 45 g that together form a second enclosed hollow portion, a second tungsten heel member having a mass of 35 g or less located in a heel side of the second enclosed hollow portion, a second tungsten toe member having a mass of 50 g to 70 g located in a toe side of the second enclosed hollow portion, and a second blade length; and the third golf club comprising a third loft angle ($LA_3$) of 36 degrees or greater having a third blade length;

wherein the first, second and third blade lengths are approximately constant.

9. The set of golf clubs of claim 8, wherein the second tungsten toe member has greater mass than the first tungsten toe member and the third golf club has a third tungsten toe member with greater mass than the second tungsten toe member and wherein the first golf club has a first hosel length and the second golf club has a second hosel length that is longer than the first hosel length.

10. The set of golf clubs according to claim 9, wherein the first tungsten toe member has a mass of between 38 g and 50 g and the first tungsten heel member has a mass of between 34 g and 31 g; and the second tungsten toe member has a mass of between 55 g and 60 g and the second tungsten heel member has a mass of between 31 g and 20 g.

* * * * *